US005460091A

United States Patent [19]

Mazzenga et al.

[11] Patent Number: 5,460,091

[45] Date of Patent: Oct. 24, 1995

[54] PRINTING PRESS INK SUPPLY SYSTEM

[75] Inventors: Giacinto R. Mazzenga, Lake Como, Pa.; Frederick J. Elia, Sarasota, Fla.

[73] Assignee: Como Technologies, Inc., Sarasota, Fla.

[21] Appl. No.: 231,904

[22] Filed: Apr. 22, 1994

Related U.S. Application Data

[63] Continuation of Ser. No. 605,571, Oct. 30, 1990, abandoned.

[51] Int. Cl.[6] ..... B41F 31/08

[52] U.S. Cl. ..... 101/366; 101/DIG. 45

[58] Field of Search ..... 101/366, 365, 101/DIG. 45, 147, 148, 363, 364, 350; 417/18, 20, 21, 22, 415, 416, 417

[56] References Cited

U.S. PATENT DOCUMENTS

| | | | |
|---|---|---|---|
| 3,366,051 | 1/1968 | Fusco | 101/365 |
| 4,137,011 | 1/1979 | Rock | 417/22 |
| 4,180,375 | 12/1979 | Magnussen | 417/22 |
| 4,474,309 | 10/1984 | Solomon | 417/22 |
| 4,899,653 | 2/1990 | Michi et al. | 101/366 |
| 4,919,595 | 4/1990 | Likuski et al. | 417/22 |
| 4,986,919 | 1/1991 | Allington | 417/22 |
| 5,027,706 | 7/1991 | Niemiro et al. | 101/366 |

*Primary Examiner*—J. Reed Fisher

*Attorney, Agent, or Firm*—Tarolli, Sundheim & Covell

[57] ABSTRACT

An apparatus and method for use in supplying ink to a printing press includes a motor which drives a pump assembly. A control system varies the rate of operation of the motor to drive the pump assembly through an operating cycle which includes an intake portion or stroke of relatively short duration and a discharge portion or stroke of relatively long duration. A control system varies the rate of operation of the motor in such a manner as to maintain the rate of flow of ink from the pump assembly constant during the discharge portion of the operating cycle. The short duration of the intake portion of the operating cycle is maintained constant with variations in the operating speed of the printing press supplied with ink by the pump assembly. However, the duration of the relatively long discharge portion of the operating cycle of the pump assembly varies with changes in the operating speed of the printing press. The control system effects operation of the motor at rates which vary as a function of stored data during the discharge portion of the operating cycle of the pump assembly.

63 Claims, 4 Drawing Sheets

PRINTING PRESS INK SUPPLY SYSTEM

This is a continuation of application Ser. No. 07/605,571 filed on Oct. 30, 1990 now abandoned.

BACKGROUND OF THE INVENTION

The present invention relates to a new and improved apparatus and method for use in supplying ink during operation of a printing press.

During operation of offset lithographic printing presses, inker assemblies have been used to provide a flow of ink to plate rolls and blanket rolls of the printing press. A known inker assembly includes a pump assembly having a piston which is reciprocated through intake and discharge strokes by a drive assembly to pump ink to a rail or manifold.

The known inking mechanism includes a piston which is moved axially through intake and discharge strokes. The intake and discharge strokes are of equal duration. This results in a pulsating supply of ink from the pump assembly. Thus, during the discharge stroke of the piston, ink flows from the pump assembly. During the intake stroke of the piston, ink does not flow from the pump assembly. Since the intake and discharge strokes are of equal duration, the pump assembly is effective to discharge ink only during one-half of the press operating time.

During operation of the printing press disclosed in the prior art, the speed of operation of the pump assembly varies as a direct function of variations in printing press operating speed. Therefore, when the printing press is operated at a relatively slow speed, the time required for an intake stroke of the piston becomes relatively long. This results in an interruption in the discharge of ink from the pump assembly for a relatively long period of time.

The ink pump assembly of the aforementioned prior art has a piston which is reciprocated and rotated by rotation of a crank member. The speed at which the crank member moves the piston during a discharge stroke of the piston will vary. Thus, the speed of movement of the piston is the fastest during a central portion of the discharge stroke and is slowest at opposite end portions the discharge stroke. This results in an uneven flow of ink from the pump assembly during the discharge stroke of the piston.

Due to the extremely uneven flow of ink from the pump assembly shown in the aforementioned prior art, the quality of the printed product cannot be maximized. Thus, ink flows from the pump assembly only during the discharge portion of the operating cycle and does not flow from the pump assembly during the intake portion of the discharge cycle. Since the intake and discharge portions of the pump operating cycle are of equal duration, during half of the time the pump assembly is operating, the pump assembly is ineffective to discharge ink. In addition, during the discharge portion of the pump operating cycle, the flow rate of ink from the pump assembly varies from a very low flow rate at the ends of the discharge portion of the pump operating cycle to a relatively large flow rate at the center portion of the pump operating cycle.

Since the rate of flow of ink from this known pump assembly is very uneven, there is an over supply of ink during a portion of the pump operating cycle and an insufficient supply of ink during another portion of the pump operating cycle. Of course, the uneven supply of ink is detrimental to the quality of the printed product. Other known ink supply mechanisms for use in association with printing presses are disclosed in U.S. Pat. Nos. 4,461,209; 4,281,597; and 3,018,727.

SUMMARY OF THE INVENTION

The present invention provides a new and improved method and apparatus for use in supplying ink to a roll of a printing press. The apparatus includes a motor which drives a pump assembly to establish a flow of ink. A control system varies the rate of operation of the pump drive motor in such a manner as to tend to maintain a relatively constant flow of ink from the pump assembly. The control system varies the rate of operation of the motor to drive the pump assembly through an operating cycle which includes an intake portion of relatively short duration and a discharge portion of relatively long duration. In addition, the control system varies the rate of operation of the pump drive motor during the discharge portion of the operating cycle to maintain a constant rate of flow of ink from the pump assembly.

In order to have a pump operating cycle with a relatively short duration intake portion, the pump drive motor is operated at a high rate during the intake portion of the pump operating cycle. In order to have a pump operating cycle with a discharge portion of relatively long duration, the pump drive motor is operated at a relatively low rate during the discharge portion of the pump operating cycle. In order to promote a uniform rate of flow of ink from the pump assembly during the discharge portion of the operating cycle, the rate of operation of the pump drive motor is varied in such a manner as to maintain the rate of flow of ink from the pump assembly constant during the discharge portion of the operating cycle.

The control system stores data which is a function of desired operating rates of the pump drive motor during the discharge portion of the pump operating cycle. The rate of operation of the motor is then varied as a function of the stored data to effect operation of the pump assembly to discharge ink at a constant flow rate during the discharge portion of the pump operating cycle.

Although the pump drive motor is operated to discharge ink at a constant rate during the discharge portion of the pump operating cycle, the rate of operation of the pump drive motor during the discharge portion of the pump operating cycle is varied with variations in press speed. This is because the demand for ink varies with variations in press speed. However, during the short duration intake portion of the pump operating cycle, the pump drive motor is always operated at the same relatively high rage. This is done in order to minimize the duration of the intake portion of the pump operating cycle at all operating speeds of the printing press.

BRIEF DESCRIPTION OF THE DRAWINGS

The foregoing and other features of the present invention will become more apparent upon a consideration of the following description taken in connection with the accompanying drawings, wherein.

DESCRIPTION OF A SPECIFIC PREFERRED EMBODIMENT OF THE INVENTION

Printing Press

Figure 1:
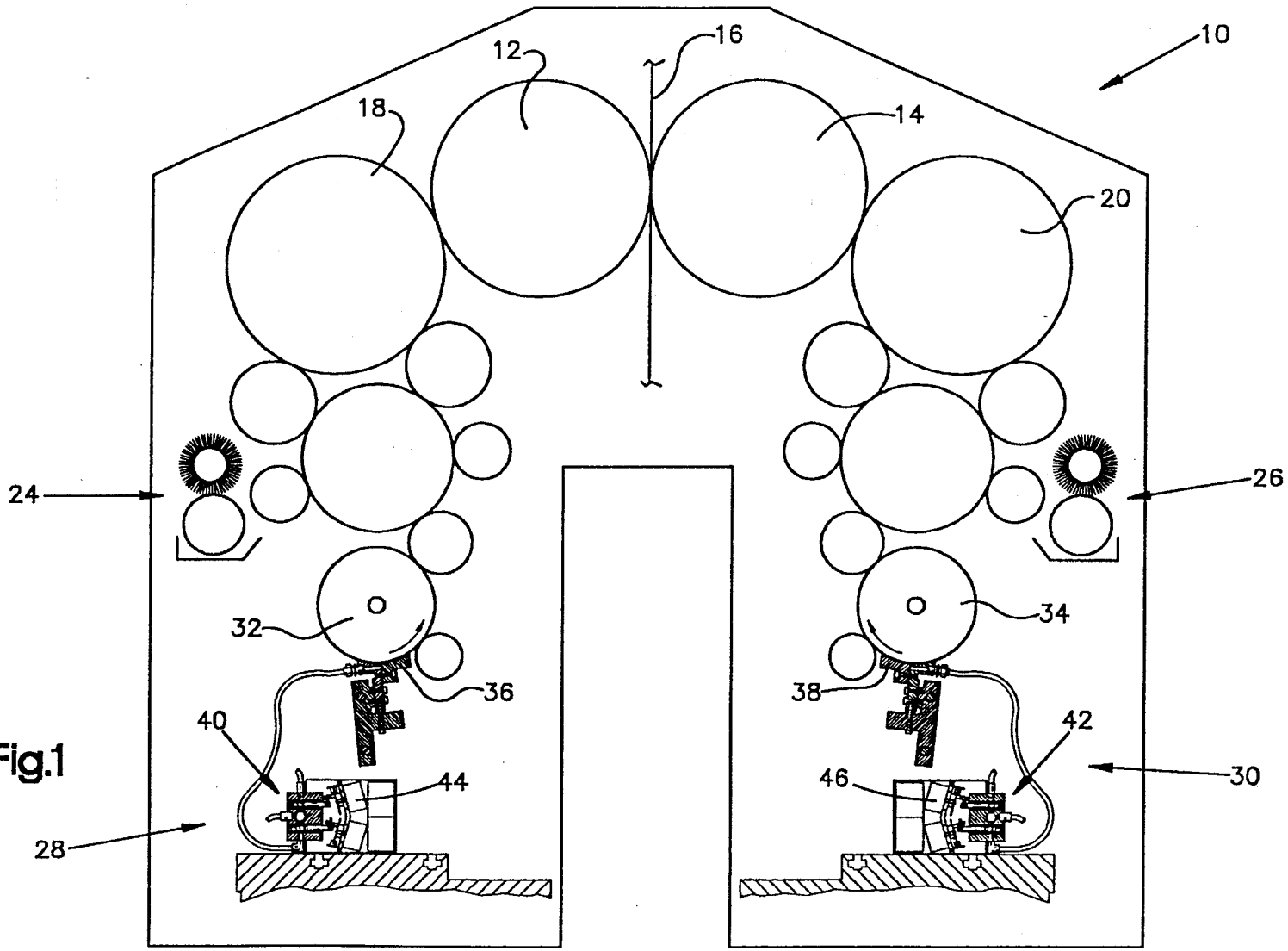
FIG. 1 is a schematic illustration of a printing press having an inker assembly constructed in accordance with the present invention.

An offset lithographic printing press 10 of a generally known construction is illustrated schematically in FIG. 1. The printing press 10 includes a pair of blanket rolls 12 and 14 which print on opposite sides of a sheet material web 16 during operation of the printing press. An ink image is transferred to the blanket rolls 12 and 14 by a pair of plate rolls 18 and 20.

To provide for the formation of an ink image on the plate rolls 18 and 20, water or other dampening solution is supplied to the plate rolls by dampener assemblies 24 and 26. Ink is applied to the surface of the plate rolls 18 and 20 by identical inker assemblies 28 and 30. Thus, during operation of the printing press, ink is applied to ink transfer rolls 32 and 34 by ink rails 36 and 38. The ink rails 36 and 38 are supplied with ink from pump assemblies 40 and 42. The pump assemblies 40 and 42 are driven by motors 44 and 46. It should be understood that each ink rail 36 or 38 is supplied with ink by a plurality, for example eight or ten, identical pump assemblies 40 or 42 driven by identical motors 44 or 46.

Although it is preferred to use inker assemblies 28 and 30 constructed in accordance with the present invention in an offset lithographic printing press, it should be understood that the inker assemblies 28 and 30 could be associated with a different type of printing press if desired. The press 10 may print on the web 16 or may be of the sheet feed type. In addition, a different type of inker assembly could be used. Thus, rather than using the ink rail 36 to apply ink to the roll 32, ink could be sprayed onto the roll or directly onto the plate roll if desired. Thus, it should be understood that the invention is not to be considered as being limited to use in any particular type of printing press.

Inker Assembly

Figure 2:
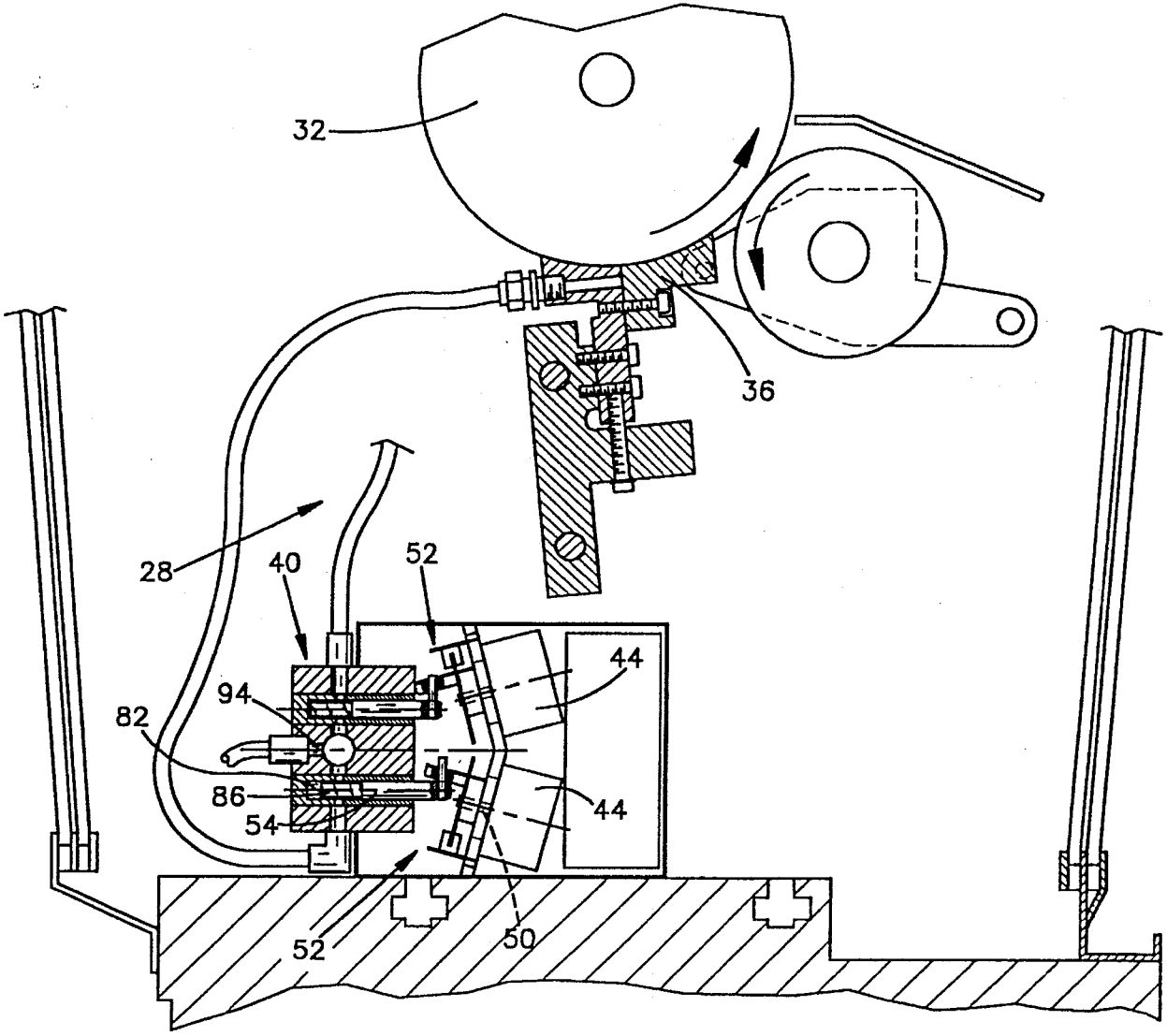
FIG. 2 is an enlarged, partially broken away illustration of the inker assembly used in the printing press of FIG. 1;.
Figure 3:
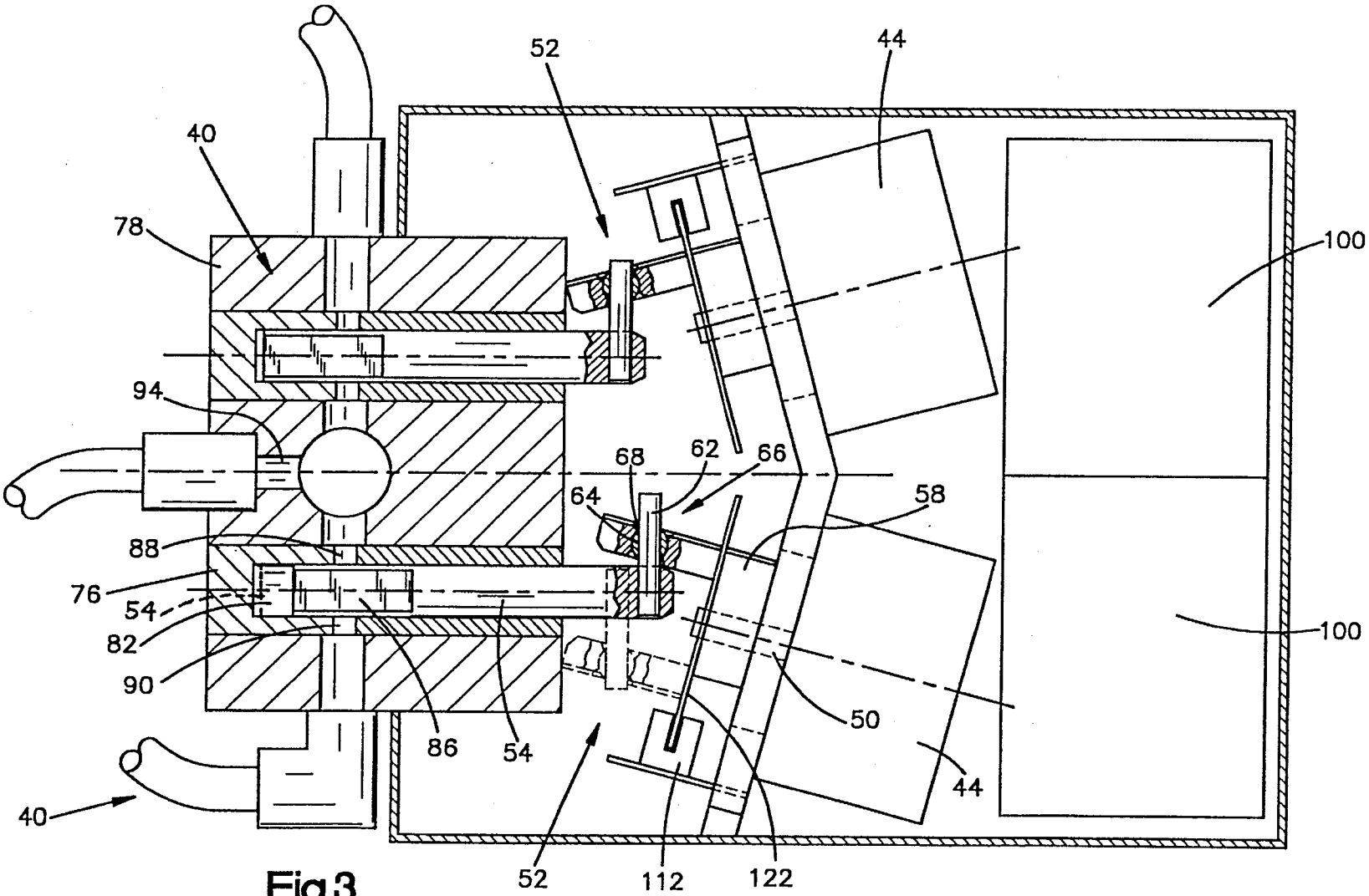
FIG. 3 is an enlarged view illustrating the relationship between a motor, drive assembly and pump assembly of the inker assembly of FIG. 2.

The inker assembly 28 includes a variable speed electric motor 44 (FIGS. 2 and 3). The motor 44 has an output shaft 50 (FIG. 3) connected with a drive assembly 52. The drive assembly 52 is in turn connected with a cylindrical piston 54 of the pump assembly 40. During operation of the motor 44, the drive assembly 52 reciprocates the piston 54 to operate the pump assembly 40. Although only a pair of electric motors 44, drive assemblies 52 and pump assemblies 40 have been shown in FIG. 2, any desired number could be used. For example, four or five pairs of electric motors 44, drive assemblies 52 and pump assemblies 40 could be used to supply ink to the ink rail 36.

The electric motor 44 is of the well known stepper type. Thus, during operation of the motor 44, the output shaft 50 is moved through equal length increments or steps. These steps occur so fast as to appear to be a continuous rotational motion.

Rotation of the motor output shaft 50 operates the drive assembly 52 to reciprocate the piston 54. Thus, the motor output shaft 50 is fixedly connected to a crank arm 58 (FIG. 3) which forms an input member for the drive assembly 52. The crank arm 58 is rotated about the central axis of the motor output shaft 50 during operation of the motor 44.

The drive assembly 52 includes a cylindrical output member or drive pin 62 which extends through a spherical ball 64 of a ball and socket type universal joint 66 (FIG. 3). The ball and socket universal joint 66 is mounted on the crank arm 58 and rotates with the crank arm. The ball and socket universal joint 66 includes a circular socket 68 which is fixedly connected with the crank arm 58. The ball 64 is rotatably held by the socket 68 and is free to rotate relative to the crank arm 58 during rotation of the crank arm.

The drive pin 62 extends through a cylindrical opening in the ball 64. During rotation of the crank arm 58, the drive pin 62 slides axially in the opening in the ball 64. The opposite end of the drive pin 62 is fixedly secured to the outer end of the piston 54. During rotation of the crank arm 58 by the motor output shaft 50, the crank arm rotates from the position shown in solid lines in FIG. 3 to the position shown in dashed lines in FIG. 3.

The general construction of the drive assembly 52 is known and is generally similar to the construction of drive assemblies disclosed in U.S. Pat. Nos. 3,168,872 and 3,366,051. It is contemplated that other known types of drive assemblies could be utilized if desired. For example, a wobble or cam plate similar to the one disclosed in U.S. Pat. No. 4,461,209 could be used if desired.

The pump assembly 40 includes a cylinder or housing 76 which is fixedly connected with a stationary base 78. The cylindrical piston 54 is slidably received in the cylinder 76 and cooperates with the cylinder to define a variable volume pump chamber 82.

The pump assembly 40 operates through one complete operating cycle for each revolution of the motor output shaft 50 and crank arm 58. Rotation of the motor output shaft 50 through one-half of a revolution rotates the crank arm 58 from the position shown in solid lines in FIG. 3 to the position shown in dashed lines. As the crank arm 58 rotates from the position shown in solid lines to the position shown in dashed lines, the piston 54 moves leftwardly (as viewed in FIG. 3) along a linear path through a discharge stroke. When the piston 54 is in the extended position shown in solid lines in FIG. 3, at the beginning of a discharge stroke, the cylindrical pump chamber 82 has a maximum volume. When the crank arm 58 is rotated to the retracted position shown in dashed lines in FIG. 3, the piston 54 will have moved through a linear discharge stroke and the pump chamber 82 will have a minimum volume.

Continued operation of the motor 44 rotates the crank arm 58 through one-half of a revolution from the position shown in dashed lines in FIG. 3 to the position shown in solid lines in FIG. 3. As this occurs, the piston 54 moves through a linear intake stroke and the size of the pump chamber increases. Thus, the volume of the pump chamber increases from a minimum volume to a maximum volume as the crank arm 58 rotates from the retracted position shown in dashed lines in FIG. 3 to the extended position shown in solid lines in FIG. 3.

As the crank arm 58 reciprocates the piston 54 along a linear path, the crank arm also rotates the cylindrical piston about its central axis. As the piston 54 is rotated, a valve surface or flat 86 on the piston rotates relative to an intake port 88 and a discharge port 90 to control fluid flow into and out of the pump chamber 82. The valve surface 86 intersects and extends parallel to a longitudinal central axis of the cylindrical piston 54.

During the intake portion of the pump operating cycle, the pump chamber 82 increases in volume. Thus, during the intake portion of the pump operating cycle, the piston 54 moves from the retracted position shown in dashed lines in FIG. 3 to the extended position shown in solid lines in FIG. 3. As this occurs, an arcuate outer side surface of the cylindrical piston 54 blocks the outlet port 90. At this time, the flat or valving surface 86 cooperates with the inlet port 88 to enable ink to flow from an inlet passage 94 through the inlet port 88 into the cylindrical pump chamber 82.

During the discharge portion of the pump operating cycle, the piston 54 moves from the extended position shown in solid lines in FIG. 3 to the retracted position shown in dashed lines in FIG. 3 with a resulting decrease in the volume of the pump chamber 82. As this occurs, the arcuate side surface of the piston 54 blocks the inlet port 88. The flat valve surface 86 on the piston cooperates with the outlet port 90 to allow ink to flow from the contracting pump chamber 82 through the outlet port.

The pump assembly 40 has a construction and mode of operation similar to the pump assemblies disclosed in U.S. Pat. Nos. 3,168,872 and 3,366,051. However, it should be understood that other known types of pump assemblies could be utilized in place of the specific pump assembly 40 illustrated in FIG. 3. If desired, a gear unit could be connected between the motor 44 and drive assembly 52 so that each revolution of the motor shaft 50 would not result in operation of the pump assembly 40 through a complete operating cycle. It should be understood that although only a pair of motors 44, drive assemblies 52 and pump assemblies 40 have been shown in FIGS. 2 and 3, additional motors, drive assemblies and pump assemblies are provided.

The construction of the drive assembly 52 is such that equal increments of rotation of the motor output shaft 50 and crank arm 58 do not result in equal increments of linear movement of the piston 54. As a result of the conversion of rotational motion of the motor output shaft 50 to linear motion of the piston 54, the displacement or movement of the piston 54 varies as a generally sinusoidal function of rotation of the crank arm 58. Thus, if the motor output shaft 50 and crank arm 58 are rotated at a constant speed, the speed of movement of the piston 54 will vary during the intake and discharge strokes. This results in a relatively large displacement of the piston 54 relative to the cylinder 76 occurring for each increment of rotation of the motor output shaft 50 and crank arm 58 when the piston 54 is near the central portion of either an intake or discharge stroke. When the piston 54 is near the beginning or end of an intake or discharge stroke, there is a relatively small displacement of the piston relative to the cylinder 76 for each increment of rotation of the motor output shaft 50 and crank arm 58.

The rate of flow of ink from the pump chamber 84 is a direct function of movement of the piston 54. In order to obtain a constant ink flow rate from the pump assembly 40, it is necessary to maintain the speed of movement of the piston 54 constant during a discharge stroke of the piston. Thus, to enable the pump assembly 40 to discharge ink through the outlet 90 at a constant flow rate, the piston 54 must move at a constant speed from the extended position shown in solid lines in FIG. 3 to the retracted position shown in dashed lines in FIG. 3.

The drive assembly 52 cooperates with the piston 54 in such a manner that if the motor output shaft 50 is rotated at a constant speed, the speed of movement of the piston 54 varies. Thus, if the speed of operation of the motor 44 is maintained constant, the flow rate of ink from the pump assembly 40 will vary. During constant speed rotation of the motor output shaft 50, there will be a relatively small or low flow rate of ink from the pump assembly 40 when the piston 54 is adjacent to either its beginning or end of stroke positions. There will be a relatively large flow rate of ink from the pump assembly 40 when the piston 54 is adjacent to the central portion of its stroke.

This uneven flow of ink from the pump assembly 40 during rotation of the motor output shaft 50 at a constant speed results from the conversion of the circular rotational motion of the crank arm 58 to linear motion of the piston 54. Of course, a nonuniform flow rate of ink from the pump assembly 40 during a discharge stroke of the piston 54 is detrimental to the quality of print obtained with the printing press.

During an intake stroke of the pump assembly 40, the flow of ink from the pump assembly is stopped. However, during the intake stroke of the pump assembly, the printing press is still printing on the web 16 (FIG. 1). Therefore, the demand for ink continues during the intake stroke of the pump assembly 40. If the motor output shaft 50 is rotated at a constant speed, the duration of an intake stroke of the pump assembly 40 is equal to the duration of the discharge stroke of the pump assembly. Therefore, during one-half of the time the pump assembly 40 is being operated, there would be no ink flow from the pump assembly.

Although there is a constant demand for ink by the printing press 10 during operation of the printing press, the demand for ink varies as a function of operating speed of the printing press. Thus, when the printing press 10 is operating at a relatively slow speed, the amount of ink applied to the web 16 for each increment of time is less than the amount of ink applied to the web 16 for each increment of time when the printing press is operating at a high speed. Therefore, the greater the operating speed of the printing press, the greater is the need for ink to be discharged from the pump assembly 40.

Motor Control System

In accordance with one of the features of the present invention, the operating speed of the motor 44 is varied to drive the pump assembly 40 through an operating cycle which includes an intake portion of relatively short duration and a discharge portion of relatively long duration. The relatively short duration of the intake stroke minimizes the time during which there is no flow ink from the pump assembly 40 during each operating cycle of the pump assembly. The relatively long duration of the discharge stroke maximizes the time during which there is a flow of ink from the pump assembly 40 during each operating cycle of the pump assembly.

In accordance with another feature of the present invention, the rate of operation of the motor 44 is varied to maintain the rate of flow of ink from the pump assembly 40 constant during the discharge portion of pump operating cycle. Thus, during the discharge portion of the pump operating cycle, the speed of operation of the motor 44 is varied so that during equal increments of time, the piston 54 is moved through equal distances relative to the cylinder 76. This results in a constant rate of flow of ink from the pump assembly 40 during the discharge portion of the pump operating cycle.

In accordance with another feature of the invention, the speed of operation of the motor 44 is varied as a direct function of variations in press operating speed during the discharge portion of a pump operating cycle. However, during the intake portion of a pump operating cycle, the motor 44 is operated at a very high speed which is not a function of press operating speed. This enables the intake portion of the pump operating cycle, during which there is no flow of ink from the pump assembly 40, to be completed as fast as possible by operating the motor 44 as fast as possible and independently of press operating speed. However, during the discharge portion of the pump operating cycle, the speed of operation of the motor 44 is a function of press operating speed and the demand for ink.

During operation of the pump assembly 40, the speed of operation of the motor 44 is varied to minimize the duration of the intake portion of the pump operating cycle and to maximize the duration of the discharge portion of the pump operating cycle. Thus, in one specific embodiment of the invention, the piston 54 was moved through an intake stroke, that is, from the position shown in dashed lines in FIG. 3 to the position shown in solid lines in FIG. 3, in about 0.125 seconds. Depending upon press operating speed and the demand for ink, the operating speed of the pump during the discharge stroke could be such as to have a discharge stroke of a duration which is between 5 and 100 times the duration of the intake stroke. Thus, depending upon the demand for ink, the motor 44 is operated to move the piston 54 from the position shown in solid lines in FIG. 3 to the position shown in dashed lines in FIG. 3 in 0.625 to 12.50 seconds while the intake stroke is completed in only 0.125 seconds.

By having the duration of the discharge stroke of the pump assembly 40 be between 5 and 100 times the duration of the intake stroke, a flow of ink is maintained from the pump assembly 40 during the large majority of each operating cycle of the pump assembly. Of course, the duration of the discharge portion of the pump operating cycle will vary as a function of the amount of ink required to print specific text or images on the web 16. The duration of the discharge portion of the pump operating cycle will also vary as a function of operating speed of the printing press 10. Thus, the slower the operating speed of the printing press, the longer is the discharge portion of the pump operating cycle.

Since the duration of the intake portion of the pump operating cycle is so much shorter than the duration of the discharge portion of the pump operating cycle, the flow of ink from the pump assembly 40 appears to be relatively uniform. This is because a flow of ink from the pump assembly 40 is established and maintained during the relatively long discharge portion of the pump operating cycle. A brief interruption in ink flow from the pump assembly 40 for the intake portion of the pump operating cycle causes only what appears to be a minor fluctuation in the pressure of the ink flow. Of course, this tends to promote a uniform supply of ink at the rail 36 (FIG. 2) and to enhance the quality of the material printed on the web 16.

Although the intake portion of the pump operating cycle is of a relatively short duration, the velocity of the piston 54 varies greatly during the intake portion of the pump operating cycle. At the beginning and end of an intake stroke, the speed of movement of the piston 54 is relatively slow. However, during the relatively large central portion of the intake stroke, the piston 54 is moving very fast. Thus, the motor 44 is operated at a constant, high speed, during the intake stroke. In converting the constant speed rotational motion of the motor output shaft 50 to linear motion of the piston 54, the drive assembly 52 causes the speed of the piston and the rate of flow of ink into the pump assembly 40 to vary through a large range.

During the relatively long duration of the discharge portion of the pump operating cycle, the speed of operation of the motor 44 is varied to maintain a constant rate of flow of ink from the pump assembly 40. Once the pump operating cycle has shifted from the intake portion to the discharge portion, the piston 54 moves through equal increments of distance relative to the cylinder 76 during equal increments of time. Thus, the speed of movement of the piston 54 remains constant during the discharge portion of the pump operating cycle.

In the illustrated embodiment of the invention, the motor 44 is of the well known stepper type in which the motor is energized to move through incremental distances or steps. The speed at which each step of the motor occurs remains constant. However, the frequency of the steps is varied to vary the rate of operation of the motor.

To obtain a high rate of ink flow into the pump assembly 40, the stepper motor 44 is operated to take steps at a very high frequency. To maintain a relatively low rate of flow of ink from the pump assembly 40, the stepper motor 44 is operated to take steps at a relatively low frequency. By operating the motor 44 to take steps at a high frequency during the intake portion of the operating cycle of the pump assembly 40 and by operating the motor to take steps at a low frequency during the discharge portion of the pump operating cycle, the intake portion of the pump operating cycle is of very short duration compared to the duration of the discharge portion of the pump operating cycle. Of course, other known types of variable speed motors could be utilized if desired.

The rate of operation of the motor 44 is varied during the discharge portion of the pump operating cycle to maintain a constant flow rate of ink from the pump assembly 40. If the motor 44 is operated at a constant rate during the discharge portion of the pump operating cycle, the drive assembly 52 causes the speed of movement of the piston 54 would vary in a sinusoidal manner. Of course, this would result in variations in the rate of flow of ink from the pump assembly 40.

To maintain a constant rate of flow of ink from the pump assembly 40 during the discharge portion of the pump operating cycle, the rate of operation of the motor 44 is varied to maintain the velocity of the piston 54 constant. Since the piston 54 has a constant velocity, the piston moves through the same incremental distance for each unit of time. Therefore, the volume of ink discharged from the pump chamber 82 remains the same for each unit of time.

During the intake portion of the pump operating cycle, the motor 44 is operated at a constant speed which is as fast as is practically possible. This results in the duration of the intake portion of the pump operating cycle being as short as is practically possible. Since the motor 44 is operated at a relatively high constant speed during the intake portion of a pump operating cycle, the speed of movement of the piston 54 varies sinusoidally during the intake portion of the pump operating cycle. The speed of movement of the piston and the flow of ink into the pump chamber 82 will be a maximum when the piston is moving through a central portion of its operating stroke. The speed of movement of the piston 54 and the rate of flow of ink into the pump chamber 82 will be relatively low when the piston is adjacent to either end of its operating stroke.

During the discharge portion of the pump operating cycle, the speed of operation of the motor is varied. However, the average speed of operation of the motor 44 during the discharge portion of the pump operating cycle is always substantially less than the average speed of operation of the motor 44 during the intake portion of the pump operating cycle. During the discharge portion of the pump operating cycle, the speed of operation of the motor 44 is the greatest when the piston 54 is adjacent to the opposite ends of its discharge stroke and is the least when the piston is adjacent to a central portion of its discharge stroke. Although the speed of operation of the motor 44 varies, the speed of movement of the piston 54 remains constant during the discharge portion of pump operating cycle.

Figure 4:
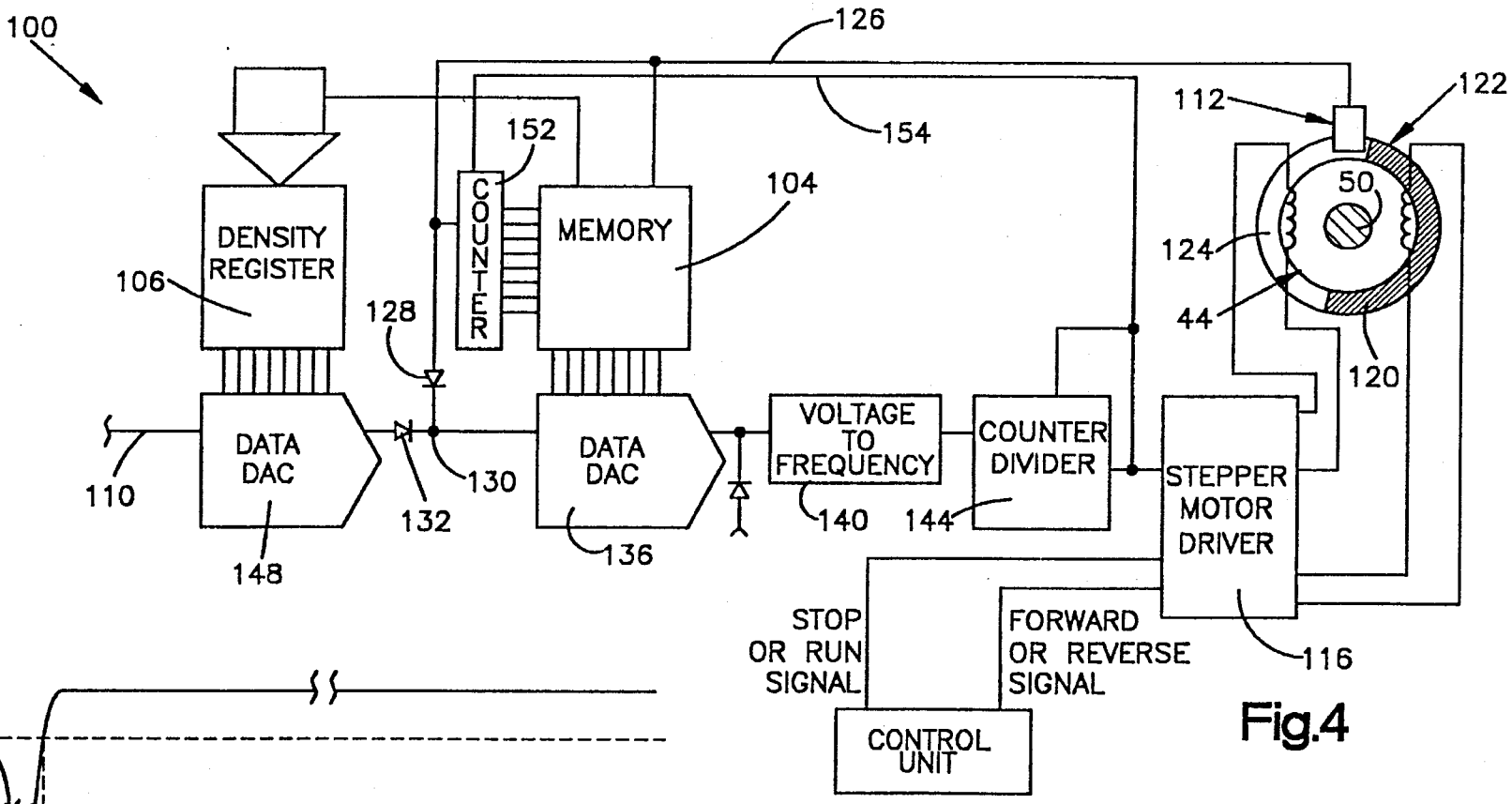
FIG. 4 is a schematic illustration of a control system used to control the rate of operation of the motor of FIG. 3.

One specific embodiment of a motor control system 100 for controlling the speed of operation of the motor 44 is illustrated schematically in FIG. 4. The control system 100 includes a data storage unit or memory 104. The data storage unit 104 stores data corresponding to multipliers by which a nominal speed of operation of the motor 44 must be varied to effect operation of the drive assembly to move the piston 54 at a constant speed during the discharge portion of a pump operating cycle.

During operation of the printing press 10 at a constant speed, ink pump drive motors, corresponding to the motor 44, have previously been driven at a constant nominal speed. This constant nominal speed of motor operation has resulted in the ink pump piston being moved at a variable speed by the drive assembly. In accordance with a feature of the invention, the data storage unit contains data or multipliers by which the previous constant nominal speed of operation of the ink pump drive motor is varied during the discharge portion of the pump operating cycle to effect movement of the piston 54 at a constant speed.

A density register 106 (FIG. 4) stores data which varies as a function of the ink density applied to a portion of the web supplied with ink by the pump assembly 40. Thus, the greater the ink density on the printed portion of the page supplied with ink by the pump assembly 40, the greater the speed of operation of the motor 44 to supply the demand for ink by the pump assembly.

Although the operating speed of the motor 44 is varied during the discharge portion of a pump operating cycle to maintain a constant rate of flow of ink from the pump assembly 40, the rate of operation of the motor 44 is also varied as a function of press operating speed. Thus, a printing press speed input or reference signal is received by the motor control system 100 from a tachometer (not shown) driven by the press drive system. The press speed reference signal is conducted over a lead 110 to the motor control system 100.

A detector assembly 112 is provided in association with the pump drive motor 44 to detect the end of a discharge stroke and the beginning of an intake stroke of the pump assembly 40. In addition, the detector assembly 112 detects the end of an intake stroke and the beginning of a discharge stroke of the pump assembly 40.

A stepper motor driver 116 is connected, through suitable circuitry, with the data storage units 104 and 106 and with the press speed input signal conducted over the lead 110. During the intake portion of the pump operating cycle, the stepper motor driver 116 effects operation of the stepper motor 44 at a very high constant speed which is independent of ink density and press operating speed. During the discharge portion of a pump operating cycle, the stepper motor driver 116 effects operation of the motor 44 at a relatively low speed which is varied as a function of the speed multipliers stored in the register 104, a factor for ink density on the printed page as represented by data stored in the register 106, and a printing press speed signal conducted over the lead 110. It is contemplated that the speed of operation of the printing press will probably remain constant, at a selected speed, during most of the time the printing press is operated to print particular material.

Operation

Upon initiation of an intake stroke of the pump assembly 40, a dark or opaque area 120 on a disk 122 connected with the motor output shaft 50 moves away from the sensor 112 and a light or transparent area 124 on the disk moves to the sensor assembly 112. The dark and light areas 120 and 124 both extend for one-half of the circumference of the disk 122. The crank arm 58 (FIG. 3) extends through an opening (not shown) in the disk 122. Both the crank arm 58 and disk 122 rotate together with the motor output shaft 50.

When the light or transparent area 124 on the disk 122 moves to the sensor head 124, light from an LED is transmitted through the disk to a photodiode. A relatively high voltage signal is then transmitted over a lead 126 to indicate the initiation of the intake portion of the pump operating cycle. Many different types of sensors 112 could be used to detect the beginning and the end of the intake and discharge portions of the pump operating cycle. However, in one specific embodiment of the invention, the sensor 112 was obtained from Texas Instruments of Dallas, Tex. under the designation of a TIL 147A Optoelectronic Assembly. Of course, other known types of sensors could be used if desired.

The high voltage intake signal on the lead 126 is transmitted through a diode 128 to a junction 130. During the intake portion of an operating cycle of the ink pump assembly 40, the voltage conducted over the lead 126 through the diode 128 is always far greater than the voltage conducted to a second diode 132. Therefore, transmission through the diode 132 is blocked during the intake portion of the pump operating cycle. The high voltage of the signal conducted from the sensors 112 to the junction 130 during the intake portion of a pump operating cycle is of a substantially greater magnitude than the maximum possible voltage signal which will be conducted to the diode 132.

During the intake portion of the pump operating cycle, a relatively high voltage is conducted from the junction 130 to a multiplying digital-to-analog converter 136. The digital-to-analog converter 136 multiplies the input voltage by a constant to still further increase the magnitude of the voltage. In one specific embodiment of the invention, the digital-to-analog converter 136 was obtained from Analog Devices of Two Technology Way of Norwood, Mass. under the designation of AD 7523 Multiplying D/A Converter. However, other known types of digital-to-analog converters could be used if desired.

The high voltage output from the digital-to-analog converter 136 is conducted to a voltage-to-frequency converter 140. In one specific embodiment of the invention, the voltage-to-frequency converter was obtained from Analog Devices of Two Technology Way of Norwood, Massachusetts under the designation of A/D 537 Voltage-to-Frequency Converter. However, it should be understood that other known types of voltage-to-frequency converters could be utilized if desired.

The extremely high frequency output from the voltage-to-frequency converter 140 is conducted to a count divider 144. The count divider 144 divides the relatively high frequency input by a factor, for example 256, to reduce the very high frequency to a range which can be used by the stepper motor driver 116. The output from the count divider 144 is transmitted to the stepper motor driver 116.

The high frequency series of pulses from the count divider 144 effect operation of the stepper motor driver 116 to operate the pump drive motor 44 at a relatively high speed. Thus, the time between pulses conducted to the stepper motor driver during an intake portion of a pump operating cycle is very short and the motor 44 drives the pump 40 as fast as is reasonably possible to minimize the duration of the intake portion of the pump operating cycle. In one specific embodiment of the invention, the stepper motor driver was obtained from SGS-Thompson of Phoenix, Ariz. under the designation of GS-D200. Of course, other known stepper motor drives could be utilized if desired.

During the intake stroke of the pump assembly 40, the motor 44 operates at a constant and very high rate which is substantially greater than any possible rate at which the motor is operated during a discharge portion of the pump operating cycle. Therefore, the intake portion of the pump operating cycle is of very short duration and the ink quickly flows into the pump chamber 82. Although the rate of operation of the motor 44 remains constant during the intake portion of the pump operating cycle, the speed of movement of the piston 54 varies sinusoidally due to the action of the drive assembly 52. Therefore, although the intake stroke is of very short duration, the flow rate during the intake stroke varies from a minimum flow at the beginning and end of the intake stroke of the piston 54 to a relatively large maximum flow rate as the piston is moving through the central portion of the intake stroke.

Figure 5:
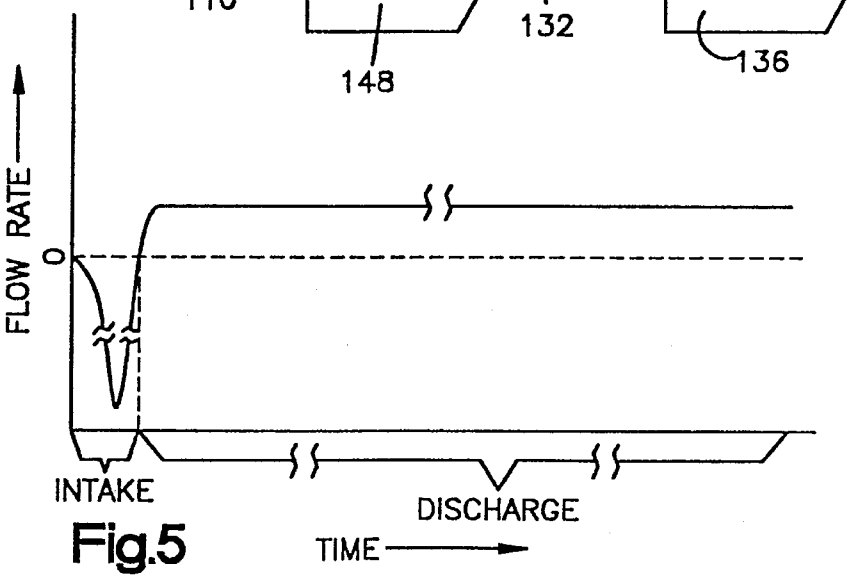
FIG. 5 is a graph depicting ink flow rates during intake and discharge portions of a pump operating cycle.

The manner in which the flow of ink into the pump assembly 40 varies with time during the intake and discharge portions of the pump operating cycle has been illustrated schematically in FIG. 5. It should be noted that, during the intake portion of the pump operating cycle, the flow rate has been shown as being negative in FIG. 5 to indicate that the ink flow is into the pump assembly. During the discharge portion of the pump operating cycle the flow rate is shown as being positive in FIG. 5 to indicate that the ink is flowing from the pump assembly.

The end of the intake portion of the pump operating cycle is detected by the detector assembly 112. During the intake portion of the pump operating cycle, the motor output shaft 50 rotates through 180°. The disk 122 rotates with the motor output shaft 50. At the end of the intake portion of the pump operating cycle, the light transparent area 124 on the disk 122 moves away from the sensor 112 and the dark or opaque area 120 moves to the sensor. As this occurs, the output voltage conducted over the lead 126 from the sensor 112 immediately decreases to a relatively low value to indicate the beginning of the discharge portion of the pump operating cycle.

The press operating speed voltage signal conducted over the lead 110 from a press driven tachometer to a digital-to-analog converter 148 is multiplied by an ink density factor conducted from a register 106. The ink density factor at the register 106 is set by a press operator to correspond with the density of the ink on the portion of the web supplied with ink by the pump assembly 40. The output from the digital-to-analog converter 148 is conducted to the diode 132. The digital-to-analog converter 148 is of the same construction as the digital-to-analog converter 136.

During the discharge portion of the pump operating cycle, the output voltage from the digital-to-analog converter 148 will be substantially greater than the relatively low voltage conducted from the sensor 112 over the lead 126. Therefore, the relatively high output voltage from the digital-to-analog converter 148 is transmitted through the diode 132 to the junction 130 and blocks the transmission of the relatively low voltage through the diode 128.

A counter 152 is reset by the change in the voltage on the lead 126 from a relatively high voltage to a relatively low voltage indicating the beginning of the discharge portion of the ink pump operating cycle. The second digital-to-analog converter 136 multiplies the reference voltage from the first digital-to-analog converter 148 by data transmitted from the register 104. The data transmitted from the register 104 is a multiplier by which the nominal speed signal voltage from the digital-to-analog converter must be multiplied to obtain the desired constant ink flow rate during the first increment of the discharge portion of the pump operating cycle.

The output from the digital-to-analog converter 136 is changed to a frequency signal by the voltage-to-frequency converter 140. The frequency of this signal is reduced by the count divider 144. The first pulse from the count divider 144 is transmitted over a lead 154 to the counter 152 to step the counter to read data from the next data storage location in the register 104. In addition, the first pulse is transmitted to the stepper motor driver 116 to effect operation of the motor 44 through one step or increment.

The change in the data transmitted from the register 104 to the digital-to-analog converter 136 changes the voltage transmitted to the voltage-to-frequency converter 140. Therefore, the frequency of the next pulse transmitted to the stepper motor driver 116 is changed.

The foregoing steps are repeated to vary the speed of operation of the motor 44 in accordance with the data stored in the register 104 during the discharge portion of the pump operating cycle. The data stored in the register 104 is calculated so as to vary the rate of operation of the motor 44 to maintain the speed of movement of the pump piston 54 constant during the discharge portion of a pump operating cycle. Therefore, during the discharge portion of the pump operating cycle, a constant flow rate of ink is maintained from the pump assembly 40, in the manner illustrated schematically in FIG. 5.

During the discharge portion of the pump operating cycle, the motor 44 is operated through one-half of a revolution. Although the speed of operation of the motor 44 varies, the motor is operated at a relatively low rate so that the speed of movement of the piston 54 is relatively slow. This results in the discharge portion of the pump operating cycle being of a substantially greater duration than the intake portion of the pump operating cycle.

Since the voltage signal conducted over the lead 110 to the digital-to-analog converter 148 varies in magnitude as a function of variations in press operating speed, the speed at which the motor 44 is driven during the discharge portion of the pump operating cycle is varied as a function of press operating speed. However, during the intake portion of the pump operating cycle, a relatively high and constant voltage conducted over the lead 126 from the sensor 112 effects operation of the motor 44 at a relatively high and constant speed to enable the intake portion of the pump operating cycle to be completed as fast is reasonably possible. Therefore, during the intake portion of the pump operating cycle, the speed of operation of the motor 44 is independent of press operating speed.

The motor control system 100 for controlling the speed of operation of only one of the motors 44 and associated pump assembly 40 is illustrated in FIG. 4. However, a motor control system 100 is provided in association with each of the motors 44 and pump assemblies 40.

A main control assembly 160 is provided in association with the printing press 10. The main control assembly 160 (FIG. 4) can be manually actuated to transmit a stop signal over a lead 162 to interrupt operation of the stepper motor driver 116. In addition, the main press control assembly 160 can be actuated to transmit a signal over a lead 164 to determine whether the motor 44 is driven in a clockwise or counterclockwise direction. In one specific instance, the control assembly 60 was an Intel 80286 Microprocessor. However, other suitable control assemblies could be used if desired.

Conclusion

In view of the foregoing description, it is apparent that the present invention provides a new and improved method and apparatus for supplying ink to a roll 12 of a printing press 10. The apparatus includes a motor 44 which drives a pump assembly 40 to establish a flow of ink. A control system 100 varies the rate of operation of the motor 44 in such a manner as to tend to maintain a relatively constant flow of ink from the pump assembly 40. The control system 100 varies the rate of operation of the motor 44 to drive the pump assembly 40 through an operating cycle which includes an intake portion of relatively short duration and a discharge portion of relatively long duration. In addition, the control system 100 varies the rate of operation of the pump drive motor 44 during the discharge portion of the operating cycle to maintain a constant rate of flow of ink from the pump assembly 40.

In order to have a pump operating cycle with a relatively short duration intake portion (FIG. 5), the motor 44 is operated at a high rate during the intake portion of the pump operating cycle. In order to have a pump operating cycle with a discharge portion of relatively long duration, the motor 44 is operated at a relatively low rate during the discharge portion of the pump operating cycle. In order to promote a uniform rate of flow of ink from the pump assembly during the discharge portion of the operating cycle, the rate of operation of the pump drive motor 44 is varied in such a manner as to maintain the rate of flow of ink from the pump assembly 40 constant during the discharge portion of the operating cycle.

The control system stores data which is a function of desired operating rates of the pump drive motor 44 during the discharge portion of the operating cycle. The rate of operation of the motor 44 is then varied as a function of the stored data to effect operation of the pump assembly 40 to discharge ink at a constant flow rate during the discharge portion of the pump operating cycle.

Although the pump assembly 40 is operated to discharge ink at a constant rate during the discharge portion of the pump operating cycle, the rate of operation of the pump drive motor 44 during the discharge portion of the pump operating cycle is varied with variations in press speed. This is because the demand for ink varies with variations in press speed. However, during the short duration intake portion of the pump operating cycle, the pump drive motor 44 is always operated at the same relatively high rate. This is done in order to minimize the duration of the intake portion of the pump operating cycle at all operating speeds of the printing press.

Having described a specific preferred embodiment of the invention, the following is claimed:

1. An apparatus comprising a printing press having a plurality of rolls, a pump assembly for establishing a flow of ink to at least one of the rolls of said printing press, said pump assembly being operable through an operating cycle which includes an intake portion during which ink flows into the pump assembly and a discharge portion during which ink flows from the pump assembly, motor means for driving said pump assembly, and control means for varying the rate of operation of said motor means to drive said pump assembly through an operating cycle which includes an intake portion and a discharge portion, said control means including means for varying the rate of operation of said motor means during the discharge portion of the operating cycle of said pump assembly to maintain the rate of flow of ink from said pump assembly constant during the discharge portion of the operating cycle.

2. An apparatus as set forth in claim 1 wherein said pump assembly includes a piston and cylinder which cooperate to at least partially define a pump chamber, said motor means being connected with said piston and being operable to move said piston relative to said cylinder, said control means including means for varying the rate of operation of said motor means to maintain the speed of movement of said piston relative to said cylinder constant during the discharge portion of an operating cycle of said pump assembly.

3. An apparatus as set forth in claim 1 wherein said pump assembly includes a piston and cylinder, said control means including means for varying the rate of operation of said motor means to move said piston relative to said cylinder at a first average speed during the intake portion of the operating cycle of said pump assembly and to move said piston relative to said cylinder at a second average speed during the discharge portion of the operating cycle of said pump assembly, said first average speed being substantially greater than said second average speed.

4. An apparatus as set forth in claim 1 wherein said control means includes detector means for detecting the beginning of the intake portion of an operating cycle of said pump assembly and for detecting the beginning of the discharge portion of an operating cycle of said pump assembly, and means for operating said motor means at a constant speed in response to said detector means detecting the beginning of the intake portion of the operating cycle of said pump assembly and for operating said motor means at a varying speed in response to said detector means detecting the beginning of the discharge portion of the operating cycle of said pump assembly.

5. An apparatus as set forth in claim 1 wherein said motor means includes an output shaft movable through a plurality of increments, said control means including data storage means for storing data which is a function of a desired operating rate of said motor means during each increment of the plurality of increments of movement of said output shaft, and means for varying the operating rate of said motor means as a function of the data stored in said data storage means during each increment of the plurality of increments of movement of said output shaft.

6. An apparatus as set forth in claim 1 wherein said control means includes means for storing data which is a function of a desired rate of operation of said motor means during the discharge portion of the pump operating cycle and means for varying the rate of operation of said motor means as a function of the stored data during the discharge portion of the pump operating cycle.

7. An apparatus as set forth in claim 1 wherein said control means includes detector means for detecting the beginning of the discharge portion of the pump operating cycle, data storage means for storing data which is a function of a desired rate of operation of said motor means during each increment of a plurality of increments of the discharge portion of the pump operating cycle, and means for varying the rate of operation of said motor means as a function of the stored data during the discharge portion of the pump operating cycle.

8. An apparatus as set-forth in claim 7 wherein said detector means includes means for detecting the beginning of the intake portion of the pump operating cycle, said control means including means for operating said motor means at a rate which is constant during the intake portion of the pump operating cycle.

9. An apparatus as set forth in claim 7 wherein said control means includes means for providing a reference signal which varies as a function of press operating speed, said means for varying the rate of operation of said motor means includes means for varying the rate of operation of said motor means as a function of both the stored data and the reference signal.

10. An apparatus as set forth in claim 1 wherein said motor means includes a rotatable output shaft connected with said pump assembly, said pump assembly being operable through a complete operating cycle during each revolution of said output shaft, said control means including means for effecting operation of said motor means to vary the rate of rotation of said output shaft throughout the portion of a revolution of said output shaft during which said pump assembly is being operated through the discharge portion of the pump operating cycle.

11. An apparatus as set forth in claim 10 wherein said control means includes means for effecting operation of said motor means to maintain the rate of rotation of said output shaft constant during the portion of a revolution of said output shaft during which said pump assembly is being operated through the intake portion of the pump operating cycle.

12. An apparatus as set forth in claim 1 wherein the duration of the discharge portion of the operating cycle of said pump assembly is at least 5 times as great as the duration of the intake portion of the operating cycle of said pump assembly.

13. An apparatus as set forth in claim 1 including drive means for transmitting force from said motor means to said pump assembly, said drive means including means for effecting operation of said pump assembly to discharge different amounts of ink from said pump assembly for equal increments of operation of said motor means during the discharge portion of the operating cycle of said pump assembly, said control means including data storage means for storing data which is a function of operating rates of said motor means required to operate said drive means to effect operation of said pump assembly to discharge ink at a constant flow rate during at least a majority of the discharge portion of the operating cycle of said pump assembly and means for effecting operation of said motor means at rates which vary as a function of the data stored in said data storage means to thereby effect operation of said drive means to operate said pump assembly to discharge ink at a constant flow rate during at least a majority of the discharge portion of the operating cycle of said pump assembly.

14. An apparatus as set forth in claim 1 wherein said pump assembly includes a cylinder and a piston disposed in said cylinder, said piston and cylinder cooperating to at least partially define a pump chamber, said piston being movable along a linear path to vary the size of said pump chamber, said apparatus further including a rotatable drive member operatively connected with said piston and with said motor means, said drive member being rotatable by said motor means to move said piston through different distances along the linear path relative to said cylinder during rotation of said drive member through a plurality of equal incremental amounts, said control means including means for effecting operation of said motor means to rotate said drive member to effect movement of said piston at a constant rate along the linear path throughout the discharge portion of the pump operating cycle.

15. An apparatus as set forth in claim 1 wherein said control means includes detector means for detecting the beginning of the discharge portion of an operating cycle of said pump assembly, data storage means for storing data which is a function of a desired operating rate of said motor means during the discharge portion of the operating cycle of said pump assembly, and means for effecting operation of said motor means at rates which vary as a function of the data stored in said data storage means throughout the discharge portion of the operating cycle of said pump assembly.

16. An apparatus as set forth in claim 1 wherein said control means includes means for varying the rate of operation of said motor means as a function of operating speed of the printing press during the discharge portion of the operating cycle of said pump assembly.

17. An apparatus as set forth in claim 16 wherein said control means includes means for maintaining the rate of operation of said motor means constant during variations in the operating speed of the printing press during the intake portion of the operating cycle of said pump assembly.

18. An apparatus comprising a printing press having a plurality of rolls, a pump assembly for establishing a flow of ink to at least one of the rolls of said printing press, said pump assembly being operable through an operating cycle which includes an intake portion during which ink flows into the pump assembly and a discharge portion during which ink flows at a constant rate from the pump assembly, motor means for driving said pump assembly, and control means for controlling the rate of operation of said motor means, said control means including data storage means for storing data which is a function of desired operating rates of said motor means during the discharge portion of the operating cycle of said pump assembly, and means for effecting operation of said motor means at rates which continuously vary as a function of the data stored in said data storage means throughout the discharge portion of the operating cycle of said pump assembly.

19. An apparatus as set forth in claim 18 wherein said control means effects operation of said motor means at a first average speed during the intake portion of the pump operating cycle and effects operation of said motor means at a second average speed which is substantially less than said first average speed during the discharge portion of the pump operating cycle.

20. An apparatus as set forth in claim 18 wherein said control means includes means for providing a reference signal which varies as a function of press speed, said control means including means for effecting operation of said motor means at rates which also vary as a function of variations in the reference signal during the discharge portion of the operating cycle of said pump assembly.

21. An apparatus as set forth in claim 18 wherein the duration of the discharge portion of the operating cycle of said pump assembly is at least 5 times as great as the duration of the intake portion of the operating cycle of said pump assembly.

22. An apparatus as set forth in claim 18 wherein said control means includes means for effecting operation of said motor means at a constant rate during the intake portion of the operating cycle of said pump assembly.

23. An apparatus as set forth in claim 18 further including detector means for detecting the beginning of the discharge portion of the operating cycle of said pump assembly and the beginning of the intake portion of the operating cycle of said pump assembly.

24. An apparatus comprising a printing press having a plurality of rolls, a pump assembly for establishing a flow of ink to at least one of the rolls of said printing press, said pump assembly including a housing, a pump element movable relative to said housing to discharge ink from said housing at a rate which is a function of the speed of movement of said pump element relative to said housing, a variable speed motor having an output shaft, drive means connected with said pump element and said output shaft of said variable speed motor for moving said pump element relative to said housing to cause ink to flow from said housing, said drive means being operable in response to rotation of said motor output shaft to move said pump element relative to said housing through distances which vary in response to rotation of said motor output shaft through a series of equal incremental distances, and control means for varying the rate of operation of said variable speed motor to maintain the speed of movement of said pump element constant during rotation of said motor output shaft through the series of equal incremental distances.

25. An apparatus as set forth in claim 24 wherein said control means includes data storage means for storing data which is a function of the desired rate of operation of said motor means during each increment of rotation of said motor output shaft in the series of equal incremental distances and means for varying the rate of operation of said motor means as a function of the data stored in said data storage means during rotation of said motor output shaft through the series of incremental distances in order to maintain the speed of movement of said pump element constant during rotation of said motor output shaft through the series of equal incremental distances.

26. An apparatus as set forth in claim 24 wherein said pump element is movable along a linear path by said motor output shaft upon rotation of said motor output shaft about a first axis, said pump element being rotatable about a second axis which is skewed relative to said first axis upon rotation of said motor output shaft about the first axis, said housing including means for defining inlet and outlet ports, said pump element including valve surface means for directing a flow of ink from the inlet port into a pump chamber and for directing a flow of ink from the pump chamber to the outlet port during each revolution of said pump element about the second axis, said pump element being movable along the linear path to increase the size of the pump chamber when said valve surface means directs a flow of ink from the inlet port into the pump chamber, said pump element being movable along the linear path to decrease the size of the pump chamber when said valve surface means directs a flow of ink from the pump chamber to the outlet port.

27. An apparatus as set forth in claim 24 wherein said motor output shaft is movable through the series of equal incremental distances during each revolution of said motor output shaft, said control means including means for varying the length of time between movement of said motor output shaft through each increment of the series of equal incremental distances to maintain the speed of movement of said pump element constant.

28. An apparatus comprising a printing press having a plurality of rolls, a pump assembly for establishing a flow of ink to at least one of the rolls of said printing press, said pump assembly being operable through an operating cycle which includes an intake portion during which ink flows into the pump assembly and a discharge portion during which ink flows from the pump assembly, motor means for driving said pump assembly, and control means for controlling operation of said motor means to maintain the duration of the intake portion of the operating cycle of said pump assembly constant with changes in operating speed of the printing press and for controlling operation of said motor means to change the duration of the discharge portion of the operating cycle of said pump assembly with changes in the operating speed of said printing press.

29. An apparatus as set forth in claim 28 wherein said control means includes means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly.

30. An apparatus as set forth in claim 28 wherein said control means includes means for varying the rate of operation of said motor means throughout the discharge portion of the operating cycle of said pump assembly to maintain the rate of flow of ink from said pump assembly constant during the discharge portion of the operating cycle.

31. An apparatus as set forth in claim 28 wherein said pump assembly includes a piston and cylinder which cooperate to at least partially define a pump chamber, said motor means being connected with said piston and being operable to move said piston relative to said cylinder, said control means including means for varying the rate of operation of said motor means to maintain the speed of movement of said piston relative to said cylinder constant throughout the discharge portion of an operating cycle of said pump assembly.

32. An apparatus as set forth in claim 28 wherein said pump assembly includes a piston and cylinder, said control means including means for varying the rate of operation of said motor means to move said piston relative to said cylinder at a first average speed during the intake portion of the operating cycle of said pump assembly and to move said piston relative to said cylinder at a second average speed during the discharge portion of the operating cycle of said pump assembly, said first average speed being substantially greater than said second average speed.

33. An apparatus as set forth in claim 28 wherein said control means includes detector means for detecting the beginning of the intake portion of an operating cycle of said pump assembly and for detecting the beginning of the discharge portion of the operating cycle of said pump assembly, and means for effecting operation of said motor means at a first rate which is independent of the operating speed of the printing press in response to said detector means detecting the beginning of the intake portion of the operating cycle of said pump assembly and for effecting operation of said motor means at a rate which varies as a function of the operating speed of the printing press in response to said detector means detecting the beginning of the discharge portion of an operating cycle of said pump assembly.

34. An apparatus as set forth in claim 28 wherein said motor means includes an output shaft movable through a plurality of increments during each revolution of said output shaft, said control means including data storage means for storing data which is a function of a desired operating rate of said motor means during each increment of the plurality of increments of movement of said output shaft, and means for varying the operating rate of said motor means as a function of the data stored in said data storage means during each increment of the plurality of increments of movement of said output shaft.

35. An apparatus as set forth in claim 28 wherein said control means includes means for storing data which is a function of a desired rate of operation of said motor means during the discharge portion of the pump operating cycle and means for varying the rate of operation of said motor means as a function of the stored data and of variations in printing press operating speed during the discharge portion of the pump operating cycle.

36. An apparatus as set forth in claim 28 wherein said control means includes detector means for detecting the beginning of the discharge portion of the pump operating cycle, data storage means for storing data which is a function of a desired rate of operation of said motor means during each increment of a plurality of increments of the discharge portion of the pump operating cycle, and means for varying the rate of operation of said motor means as a function of the stored data during the discharge portion of the pump operating cycle.

37. An apparatus as set forth in claim 36 wherein said detector means includes means for detecting the beginning of the intake portion of the pump operating cycle, said control means including means for operating said motor means at a rate which is constant during the intake portion of the pump operating cycle.

38. An apparatus as set forth in claim 36 wherein said control means includes means for providing a reference signal which varies as a function of press operating speed, said means for varying the rate of operation of said motor means includes means for varying the rate of operation of said motor means as a function of both the stored data and the reference signal.

39. An apparatus as set forth in claim 28 wherein said motor means includes a rotatable output shaft connected with said pump assembly, said pump assembly being operable through a complete operating cycle during each revolution of said output shaft, said control means including means for effecting operation of said motor means to vary the rate of rotation of said output shaft during the portion of a revolution of said output shaft during which said pump assembly is being operated through the discharge portion of the pump operating cycle.

40. An apparatus as set forth in claim 39 wherein said control means includes means for effecting operation of said motor means to maintain the rate of rotation of said output shaft constant during the portion of a revolution of said output shaft during which said pump assembly is being operated through the intake portion of the pump operating cycle.

41. An apparatus as set forth in claim 28 wherein the duration of the discharge portion of the operating cycle of said pump assembly is at least 5 times as great as the duration of the intake portion of the operating cycle of said pump assembly.

42. An apparatus as set forth in claim 28 further including drive means for transmitting force from said motor means to said pump assembly, said drive means including means for effecting operation of said pump assembly to discharge different amounts of ink from said pump assembly for equal increments of operation of said motor means during the discharge portion of the operating cycle of said pump assembly, said control means including data storage means for storing data which is a function of operating rates of said motor means required to operate said drive means to effect operation of said pump assembly to discharge ink at a constant flow rate during at least a majority of the discharge portion of the operating cycle of said pump assembly while the operating speed of the printing press remains constant and means for effecting operation of said motor means at rates which vary as a function of the data stored in said data storage means to thereby effect operation of said drive means to operate said pump assembly to discharge ink at a constant flow rate during the discharge portion of the operating cycle of said pump assembly while the operating speed of the printing press remains constant.

43. An apparatus as set forth in claim 28 wherein said pump assembly includes a cylinder and a piston disposed in said cylinder, said piston and cylinder cooperating to at least partially define a pump chamber, said piston being movable along a linear path to vary the size of said pump chamber, said apparatus further including a rotatable drive member operatively connected with said piston and with said motor means, said drive member being rotatable by said motor means to move said piston through different distances along the linear path relative to said cylinder during rotation of said drive member through a plurality of equal incremental amounts, said control means including data storage means for storing data which is a function of operating rates of said motor means required to rotate said drive member to effect movement of said piston at a constant rate along the linear path during the discharge portion of a pump operating cycle while the operating speed of the printing press remains constant and means for effecting operation of said motor means and rotation of said drive member at rates which vary as a function of both the data stored in said data storage means and the operating speed of the printing press during the discharge portion of the operating cycle of said pump assembly.

44. An apparatus as set forth in claim 28 wherein said control means includes detector means for detecting the beginning of the discharge portion of an operating cycle of said pump assembly, data storage means for storing data which is a function of a desired operating rate of said motor means during the discharge portion of an operating cycle of said pump assembly while the operating speed of the printing press remains constant, and means for effecting operation of said motor means at rates which vary as a function of both the data stored in said data storage means and the operating speed of the printing press during the discharge portion of the operating cycle of said pump assembly.

45. An apparatus as set forth in claim 28 wherein said control means includes means for varying the rate of operation of said motor means as a function of operating speed of the printing press during the discharge portion of the operating cycle of said pump assembly.

46. An apparatus comprising a printing press having a plurality of rolls, a pump assembly for establishing a flow of ink to at least one of the rolls of said printing press, said pump assembly including a housing, a pump element movable relative to said housing through an intake stroke during which ink flows into said pump assembly and a discharge stroke during which ink flows from said housing at a rate which is a function of the speed of movement of said pump element relative to said housing, a variable speed motor having an output shaft, drive means connected with said pump element and the output shaft of said variable speed motor for moving said pump element relative to said housing to cause ink to flow from said housing, said drive means being operable in response to rotation of the output shaft of said variable speed motor to move said pump element relative to said housing through distances which vary in response to rotation of the output shaft of said variable speed motor through a series of equal incremental distance, and control means for controlling the operation of said variable speed motor, said control means including means for providing a reference signal which varies as a function of operating speed of the printing press, means for maintaining the duration of the intake stroke of said pump element constant with changes in the reference signal, means for varying the duration of the discharge stroke of said pump element with variations in the reference signal, and means for varying the rate of operation of said variable speed motor to maintain the speed of movement of said pump element and the rate of discharge of ink from said pump assembly constant during rotation of the output shaft of said variable speed motor through the series of equal incremental distances while the reference signal remains constant during the discharge stroke of said pump element.

47. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including means for varying the rate of operation of said motor means during the discharge portion of the operating cycle of said pump assembly to maintain the rate of flow of ink from said pump assembly constant during the discharge portion of the operating cycle.

48. An apparatus as set forth in claim 47 wherein said pump assembly includes a piston and cylinder, said control means including means for varying the rate of operation of said motor means to move said piston relative to said cylinder at a first average speed during the intake portion of the operating cycle of said pump assembly and to move said piston relative to said cylinder at a second average speed during the discharge portion of the operating cycle of said pump assembly, said first average speed being substantially greater than said second average speed.

49. An apparatus as set forth in claim 47 wherein the duration of the discharge portion of the operating cycle of said pump assembly is at least 5 times as great as the duration of the intake portion of the operating cycle of said pump assembly.

50. An apparatus as set forth in claim 47 wherein said control means includes detector means for detecting the beginning of the discharge portion of an operating cycle of said pump assembly, data storage means for storing data which is a function of a desired operating rate of said motor means during the discharge portion of the operating cycle of said pump assembly, and means for effecting operation of said motor means at rates which vary as a function of the data stored in said data storage means during the discharge portion of the operating cycle of said pump assembly.

51. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, said pump assembly including a piston and cylinder which cooperate to at least partially define a pump chamber, motor means for driving said pump assembly, said motor means being connected with said piston and being operable to move said piston relative to said cylinder, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including means for varying the rate of operation of said motor means to maintain the speed of movement of said piston relative to said cylinder constant during the discharge portion of an operating cycle of said pump assembly.

52. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including detector means for detecting the beginning of the intake portion of an operating cycle of said pump assembly and for detecting the beginning of the discharge portion of the operating cycle of said pump assembly, and means for increasing the rate of operation of said motor means in response to said detector means detecting the beginning of the intake portion of the operating cycle of said pump assembly and for decreasing the rate of operation of said motor means in response to said detector means detecting the beginning of the discharge portion of an operating cycle of said pump assembly.

53. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, said motor means including an output shaft movable through a plurality of increments, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including data storage means for storing data which is a function of a desired operating rate of said motor means during each increment of the plurality of increments of movement of said output shaft, and means for varying the operating rate of said motor means as a function of the data stored in said data storage means during each increment of the plurality of increments of movement of said output shaft.

54. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including means for storing data which is a function of a desired rate of operation of said motor means during the discharge portion of the pump operating cycle and means for varying the rate of operation of said motor means as a function of the stored data throughout the discharge portion of the pump operating cycle.

55. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including detector means for detecting the beginning of the discharge portion of the pump operating cycle, data storage means for storing data which is a function of a desired rate of operation of said motor means during each increment of a plurality of increments of the discharge portion of the pump operating cycle, and means for varying the rate of operation of said motor means as a function of the stored data throughout the discharge portion of the pump operating cycle.

56. An apparatus as set forth in claim 55 wherein said detector means includes means for detecting the beginning of the intake portion of the pump operating cycle, said control means including means for operating said motor means at a rate which is constant during the intake portion of the pump operating cycle.

57. An apparatus as set forth in claim 55 wherein said control means includes means for providing a reference signal which varies as a function of press operating speed, said means for varying the rate of operation of said motor means includes means for varying the rate of operation of said motor means as a function of both the stored data and the reference signal.

58. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, said motor means including a rotatable output shaft connected with said pump assembly, said pump assembly being operable through a complete operating cycle during each revolution of said output shaft, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including means for effecting operation of said motor means to vary the rate of rotation of said output shaft throughout the portion of a revolution of said output shaft during which said pump assembly is being operated through the discharge portion of the pump operating cycle.

59. An apparatus as set forth in claim 58 wherein said control means includes means for effecting operation of said motor means to maintain the rate of rotation of said output shaft constant during the portion of a revolution of said output shaft during which said pump assembly is being operated through the intake portion of the pump operating cycle.

60. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, drive means for transmitting force from said motor means to said pump assembly, said drive means including means for effecting operation of said pump assembly to discharge different amounts of ink from said pump assembly for equal increments of operation of said motor means during the discharge portion of the operating cycle of said pump assembly, said control means including data storage means for storing data which is a function of operating rates of said motor means required to operate said drive means to effect operation of said pump assembly to discharge ink at a constant flow rate during at least a majority of the discharge portion of the operating cycle of said pump assembly and means for effecting operation of said motor means at rates which vary as a function of the data stored in said data storage means to thereby effect operation of said drive means to operate said pump assembly to discharge ink at a constant flow rate during at least a majority of the discharge portion of the operating cycle of said pump assembly.

61. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, said pump assembly including a cylinder and a piston disposed in said cylinder, said piston and cylinder cooperating to at least partially define a pump chamber, said piston being movable along a linear path to vary the size of said pump chamber, motor means for driving said pump assembly, a rotatable drive member operatively connected with said piston and with said motor means, said drive member being rotatable by said motor means to move said piston through different distances along the linear path relative to said cylinder during rotation of said drive member through a plurality of equal incremental amounts, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including data storage means for storing data which is a function of operating rates of said motor means required to rotate said drive member to effect movement of said piston at a constant rate along the linear path during the discharge portion of the pump operating cycle and means for effecting operation of said motor means and rotation of said drive member at rates which vary as a function of the data stored in said data storage means.

62. An apparatus comprising a printing press having a plurality of rolls, a pump assembly for establishing a flow of ink to at least one of the rolls of said printing press, said pump assembly being operable through an operating cycle which includes an intake portion during which ink flows into said pump assembly and a discharge portion during which ink flows from said pump assembly, motor means for driving said pump assembly, and control means for varying the rate of operation of said motor means to drive said pump assembly through an operating cycle which includes an intake portion of relatively short duration and a discharge portion of relatively long duration to provide a flow of ink from said pump assembly during a major portion of each operating cycle of said pump assembly, said control means including means for varying the rate of operation of said motor means as a function of operating speed of the printing press during the discharge portion of the operating cycle of said pump assembly.

63. An apparatus as set forth in claim 62 wherein said control means includes means for maintaining the rate of operation of said motor means constant with variations in the operating speed of the printing press during the intake portion of the operating cycle of said pump assembly.

* * * * *